US009577326B2

(12) United States Patent
Piau et al.

(10) Patent No.: US 9,577,326 B2
(45) Date of Patent: Feb. 21, 2017

(54) DEVICE FOR DECOUPLING ANTENNAS MOUNTED ON AN AIRCRAFT

(71) Applicant: EUROPEAN AERONAUTIC DEFENCE AND SPACE COMPANY EADS FRANCE, Paris (FR)

(72) Inventors: Pascal Piau, Lacroix Falgarde (FR); Andre De Lustrac, Sceaux (FR)

(73) Assignee: AIRBUS GROUP SAS, Blagnac (FR)

( * ) Notice: Subject to any disclaimer, the term of this patent is extended or adjusted under 35 U.S.C. 154(b) by 0 days.

(21) Appl. No.: 14/418,377

(22) PCT Filed: Jul. 30, 2013

(86) PCT No.: PCT/EP2013/065987
§ 371 (c)(1),
(2) Date: Jan. 29, 2015

(87) PCT Pub. No.: WO2014/020016
PCT Pub. Date: Feb. 6, 2014

(65) Prior Publication Data

US 2015/0194728 A1 Jul. 9, 2015

(30) Foreign Application Priority Data

Jul. 31, 2012 (FR) ..... 12 57448

(51) Int. Cl.
*H01Q 1/52* (2006.01)
*H01Q 1/28* (2006.01)
*H01Q 15/00* (2006.01)

(52) U.S. Cl.
CPC ..... *H01Q 1/521* (2013.01); *H01Q 1/28* (2013.01); *H01Q 1/286* (2013.01); *H01Q 1/526* (2013.01);

(Continued)

(58) Field of Classification Search
CPC ..... H01Q 1/521; H01Q 15/008; H01Q 15/006
See application file for complete search history.

(56) References Cited

U.S. PATENT DOCUMENTS 6,441,792 B1 * 8/2002 Sievenpiper ..... H01Q 1/521 343/713
2008/0136710 A1 * 6/2008 Nefedov ..... H01Q 15/006 343/700 MS
2009/0085444 A1 * 4/2009 Alvarez Icaza Rivera ..... H02N 11/006 310/365

FOREIGN PATENT DOCUMENTS

WO 01/69723 A1 9/2001
WO 01/73893 A1 10/2001

OTHER PUBLICATIONS

Caloz et al., "Composite right/left-handed transmission line metamaterials", IEEE Microwave Magazine, Sep. 1, 2004, pp. 34-50, vol. 5, No. 3, IEEE, Piscataway, NJ, US.

* cited by examiner

*Primary Examiner* — Hoang V Nguyen
*Assistant Examiner* — Michael Bouizza
(74) *Attorney, Agent, or Firm* — Im IP Law; C. Andrew Im

(57) ABSTRACT

A high-impedance passive device to radio-electrically decouple two antennas operating at least partially within a common frequency band and arranged on a surface of the carrier structure. A substrate of the device has a flexible dielectric material layer having a predetermined thickness with patches of conductive material arranged on its surface and a layer to attach the device onto the surface of the carrier structure. The patches having predetermined shape and arrangement. The body of the substrate separates the dielectric layer from the surface of the carrier structure. The (Continued)

substrate thickness is determined based on the size, number, and arrangement of the patches, and further it is based on the aerodynamic constraints imposed on the device. The device having an impedance to cause the desired decoupling in the common frequency band.

10 Claims, 3 Drawing Sheets

(52) U.S. Cl.
CPC ..... *H01Q 15/006* (2013.01); *H01Q 15/008* (2013.01)

DEVICE FOR DECOUPLING ANTENNAS MOUNTED ON AN AIRCRAFT

RELATED APPLICATIONS

This application is a §371 application from PCT/EP2013/065987 filed Jul. 30, 2013, which claims priority from French Patent Application No. 12 57448 filed Jul. 31, 2012, each of which is herein incorporated by reference in its entirety.

FIELD OF THE INVENTION

The invention pertains to the general field of antennas. It pertains more particularly to the problem of decoupling between antennas that are sited close together. It applies especially, but not exclusively, to the decoupling of patch antennas mounted on the fuselage of an aircraft.

CONTEXT OF THE INVENTION

Prior Art

Certain electromagnetic systems such as the radioaltimeter systems mounted on aircraft consist of two antennas, a transmitting antenna and a receiving antenna, operating in principle in the same frequency band. Accordingly to avoid direct coupling between the two antennas, which coupling disturbs the operation of the system very substantially, one tries to optimize the respective layouts of these antennas. One thus tries to place the two antennas as far apart as possible so as to limit the coupling, while maintaining a distance compatible with overall operation and with the installation constraints (mechanical constraints, length and routing of the cables, accessibility, etc.).

Thus, for example, in the particular case of a radioaltimeter installed on an aircraft the standards in force require that the two antennas be spaced a minimum distance of about 70 cm apart.

However, in addition to the fact that such a separation constraint is difficult to satisfy within the context of an aircraft, the space available on the fuselage being by nature limited, given the number of antennas onboard the aircraft, this space may appear insufficient with use, for a given aircraft, under certain conditions, to guarantee the decoupling necessary for the proper operation of the altimeter.

Now, increasing this distance often turns out to be complex, in particular if the change of position of the antennas resulting therefrom must be achieved on an aircraft already in service, for which the eventuality of having to change the position of certain items of equipment, such as antennas, has not generally been considered.

In the field of aeronautical electromagnetic equipment, the solution most commonly used to circumvent the effects of the occurring of coupling, in certain particular circumstances, consists in providing a redundancy of the systems. The measurement errors that may appear due to spurious coupling are detected by comparing the measurements delivered by each of the systems. Such a solution makes the manufacturers increase the amount of equipment mounted on the aircraft and therefore to substantially raise the weight of the latter, whereas the current tendency is to attempt to lighten the weight of aircrafts, so as in particular to lower their fuel consumption. This also entails an increase of installation and maintenance costs.

A known solution for strengthening the decoupling between two antennas that are sited close together and operating in the same frequency band consists in interposing between the two antennas a device exhibiting a high impedance in the band considered.

In the case of antennas of patch type in particular, the high-impedance device takes the form of a plane element, of small thickness, consisting of a dielectric substrate, on one face of which are disposed patches made of conducting material while the other face is covered by a conducting plane, acting as ground plane. The dimensions and shapes of the patches as well as their arrangement is mainly dependent on the frequency and on the desired decoupling. Such an element is commonly described as metasurface or metamaterial based structure.

Generally, insofar as, for a given system comprising two antennas operating in the same frequency band, a problem of direct coupling between antennas is to be feared, it is known to develop a structure grouping together at one and the same time the antennas and the high-impedance surface which is presumed to favor their decoupling. The patches constituting the antennas and, between these two patches, the arrangement of patches forming the high-impedance surface are produced at one and the same operation, on one and the same substrate, for example. A compact system having the form of a printed circuit and including the radiating elements and the decoupling device is thus obtained.

However, the decoupling of two patch antennas can be developed a posteriori by producing a high-impedance device on a separate printed circuit and by arranging this circuit between the two printed circuits constituting the antennas.

With regard to improving the decoupling of patch antennas disposed on the external surface of the fuselage of an aircraft, one is led to attempt to use the solution described above, consisting in interposing between the two antennas, in the coupling zone, a printed circuit constituting a high-impedance surface.

However the use of devices of this type, such as they are produced at the present time, poses significant technical problems.

Indeed, currently developed devices have a relatively rigid structure which is not very favorable to their installation on a surface exhibiting curvatures, the external surface of the fuselage of an aircraft for example, the surface of the device hardly fitting the profile of the surface on which it is placed, especially when the device exhibits a significant surface area.

Accordingly, even if the substrate used to produce the printed circuit constituting the high-impedance structure exhibits some elasticity, the latter is limited and maintaining the surface of the device in tight contact with the surface of the fuselage requires the use of powerful fixing means disposed at various points of the high-impedance device, generally at the periphery of said device and which in general require intervention on the structure itself.

Moreover, insofar as the surface of the device fits the surface of the fuselage more or less imperfectly, the positioning of such a device on the surface of the fuselage generates undesirable aerodynamic disturbances, even if the thickness of the device is fairly small.

PRESENTATION OF THE INVENTION

An aim of the invention is to propose a simple device making it possible to improve the decoupling between antennas in particular in the case of radioelectric equipment using several patch antennas operating in the same frequency band.

Another aim of the invention is to propose a device that is simple to produce and able to be used to equip new aircraft with appropriately decoupled antennas as well as to carry out in a simple manner an upgrade of aircrafts already in service so as to improve the decoupling of antennas already installed on the fuselage.

Stated otherwise, an aim of the invention is to propose a solution, both effective and simple to implement, to the problems of coupling that may exist between two antennas placed in proximity to one another on the surface of a not necessarily plane carrier structure, the fuselage of an aircraft for example, this solution being applicable either during the installation of the equipment concerned on the structure in question, or during a maintenance operation aimed at improving this equipment.

For this purpose the subject of the invention is a high-impedance passive device, making it possible especially to achieve radioelectric decoupling between two antennas operating at least partially in a common frequency band disposed on the surface of a carrier structure. According to the invention, the device comprises a substrate consisting of a flexible dielectric material layer of given thickness e, on the surface of which are disposed patches made of conducting material exhibiting a given geometry and a given disposition, as well as means for ensuring its fixing on a ground plane on the surface of the structure, in such a way that the layer formed by the patches is separated from the surface of the structure by the thickness of the substrate; the substrate thickness e being determined as a function of the geometry, of the number and of the disposition of the patches as well as of the aerodynamic constraints imposed on the device, the latter exhibits an impedance producing the desired decoupling in the frequency band considered.

In a particular embodiment the device according to the invention comprises:

a conducting material sheet of a given thickness and a given surface area forming a ground plane;

a plurality of patches made of conducting material spaced apart and positioned in a plane opposite said conducting material sheet at a given distance from the latter;

a dielectric material substrate of given thickness, disposed between the conducting material sheet and the patches, the thickness, e, of dielectric material between the patches and the surface of the conducting material sheet opposite said patches keeping these latter at the desired distance with respect to said sheet;

means for ensuring the fixing of the device to the surface of the structure, the fixing being carried out with the face of the conducting sheet opposite said surface.

The thickness of substrate, as well as the geometry, the number and the disposition of the patches are determined, while taking account of the external constraints, in such a way as to obtain the desired decoupling value.

The device according to the invention then comprises a ground plane integrated into its own structure and it is fixed to the surface of the carrier structure by way of this ground plane.

In another particular embodiment the ground plane on which the device according to the invention is fixed consists of the structure itself.

According to diverse variant embodiments the device according to the invention can exhibit the following characteristics which may optionally be combined.

Thus, according to an embodiment of the device according to the invention, the dielectric material of the substrate is a flexible material of elastomer type that is able to fit the shape of the surface of the structure on which the device is mounted.

According to a particular characteristic the dielectric material used is polychloroprene.

According to another embodiment of the device according to the invention, the patches are linked electrically to said conducting material sheet by conductors, or vias.

According to another embodiment the means for ensuring the fixing of the device to the surface of the structure consist of an adhesive material layer disposed on the face of the conducting sheet facing the surface of said carrier structure or on that face of the device which is intended to be fixed to this same surface.

According to another embodiment, the permittivity of the material forming the substrate, the substrate thickness, e, separating said patches of the conducting sheet as well as the dimensions of the patches and their arrangement are defined in such a way that the device exhibits the desired impedance in the considered frequency band, and that its thickness is sufficiently small to limit to the minimum the effects of the installation of the device on the aerodynamic characteristics of the structure.

According to another embodiment a substrate layer covers the plane of the patches so as to ensure mechanical and/or chemical protection of the free surface of the device, stated otherwise the face carrying the patches, and protection against erosion in particular.

According to another embodiment the external surface of the device is covered with a purely dielectric coating.

DESCRIPTION OF THE FIGURES

The characteristics and advantages of the invention will be better appreciated by virtue of the following description, which is supported by the appended figures which present.

DETAILED DESCRIPTION

In the description which follows, particular embodiments of the invention, that are very suitable for producing a device intended to limit the coupling between two antennas placed on the external wall of an aircraft, are presented by way of nonlimiting examples. It is very obvious, however, that due to its simplicity of implementation, such a device can be used to improve the decoupling of antennas placed on any wall, the external wall of a vehicle or the wall of a fixed structure, even if there is a lower degree of requirement for such equipment, especially in terms of aerodynamics.

Figure 1:
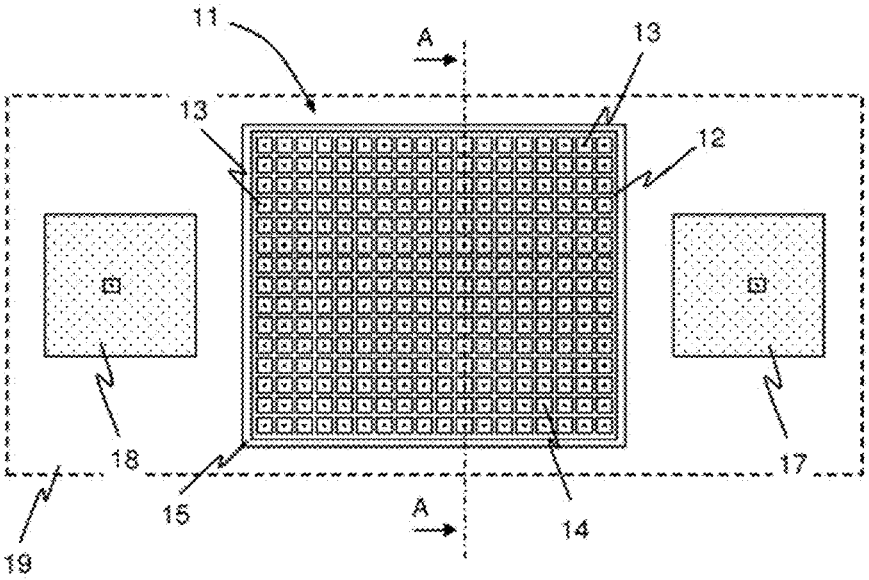
FIG. 1, an illustration of a first embodiment of the device according to the invention viewed by its external face.
Figure 2:
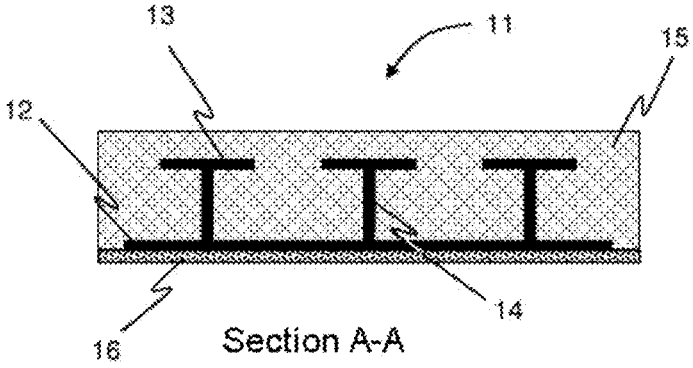
FIG. 2, an illustration, in section on A-A, of the device according to the invention in the embodiment of FIG. 1.

In a first embodiment, illustrated by FIGS. 1 and 2, the device according to the invention takes, when it is placed on a plane, the form of a flat element 11 exhibiting a conducting face 12 forming a ground plane, above which are placed conducting patches 13. These patches 13 are preferably arranged in one and the same plane according to a preferably regular arrangement, a matrix arrangement as illustrated by FIG. 1 for example. The space between the conducting face and the plane on which the patches are situated is embedded in a dielectric substrate 15.

According to a particular form of this embodiment, the conducting patches 13 are linked to the conducting face 12 by way of connection links or vias 14. Alternatively the conducting patches 13 can be insulated from the conducting face 12. Depending on the form considered the distance between the conducting face and the plane of the patches is of course different.

The size and the installation spacing of the patches 13, as well as the thickness e of substrate separating the surface of the patches from the conducting face 12, are moreover determined in such a way that the structure thus formed exhibits a high impedance for the considered frequency band, which band corresponds to the operating band of the antennas 17 and 18 whose decoupling it is desired to strengthen.

According to the invention the determination of these parameters can be carried out in any known way whatsoever, by means of radioelectric circuit design software for example.

In the case of application of the device to the decoupling of antennas placed on the external surface of the wall of an aircraft, which case corresponds to the example set forth here, the thickness e is nonetheless chosen as small as possible so that no aerodynamic turbulence is generated by putting the device in place on this wall.

The substrate used to produce the high-impedance device according to the invention advantageously consists of a flexible material, an elastomer material, chosen in particular for its dielectric and mechanical characteristics (elasticity, resistance to erosion, etc.), a polychloroprene for example. The production of the device according to the invention is then achieved by integrating the conducting patches 13, metallic patches for example, on one of the faces of the substrate 15, and the conducting layer 12, a fine metal sheet for example, on the other face, and then by electrically linking (putting vias in place) the patches 13 to the conducting layer 12 through the substrate 15. In the case where the patches and the conducting layer are metallic elements, the electrical links 14 are produced by drilling right through the substrate 15 at the level of the patches 13 and by filling the drillholes produced with a brazing metal.

In a particular embodiment, suitable especially for the production of high-impedance devices intended to be mounted on the fuselage of an aircraft, the surface of the patches 13 is covered with a coating which limits the erosion thereof. This coating can consist of an upper layer of elastomer material, the material constituting the substrate generally, as in the exemplary embodiment illustrated by FIG. 2. It can also consist of a layer of paint exhibiting the desired dielectric characteristics.

Due to its flexible and elastic structure, the device 11 thus produced is advantageously able to be placed on a surface which is not necessarily plane, the face of the device which bears on said surface, the face which carries the conducting layer 12 generally, being able to adapt its shape naturally so as to fit the profile of the surface considered. Accordingly, the fixing of the device and its adjustment on this surface, which are achieved while subjecting the substrate 15 to a minimum of constraints, are advantageously made easier with respect to a device comprising a rigid substrate. The device according to the invention can therefore be set and held in place, in contact with the surface 19, by any fixing means.

Preferably, the device according to the invention is fixed to the surface considered by simple gluing. For this purpose, the structure described above can advantageously be supplemented with a layer 16 of adhesive material, an acrylic glue film for example, covering the face of the device by which it rests on the structure, that is to say, in the case of the embodiment considered, the face of the substrate 15 which carries the conducting layer 12 generally.

Figure 3:
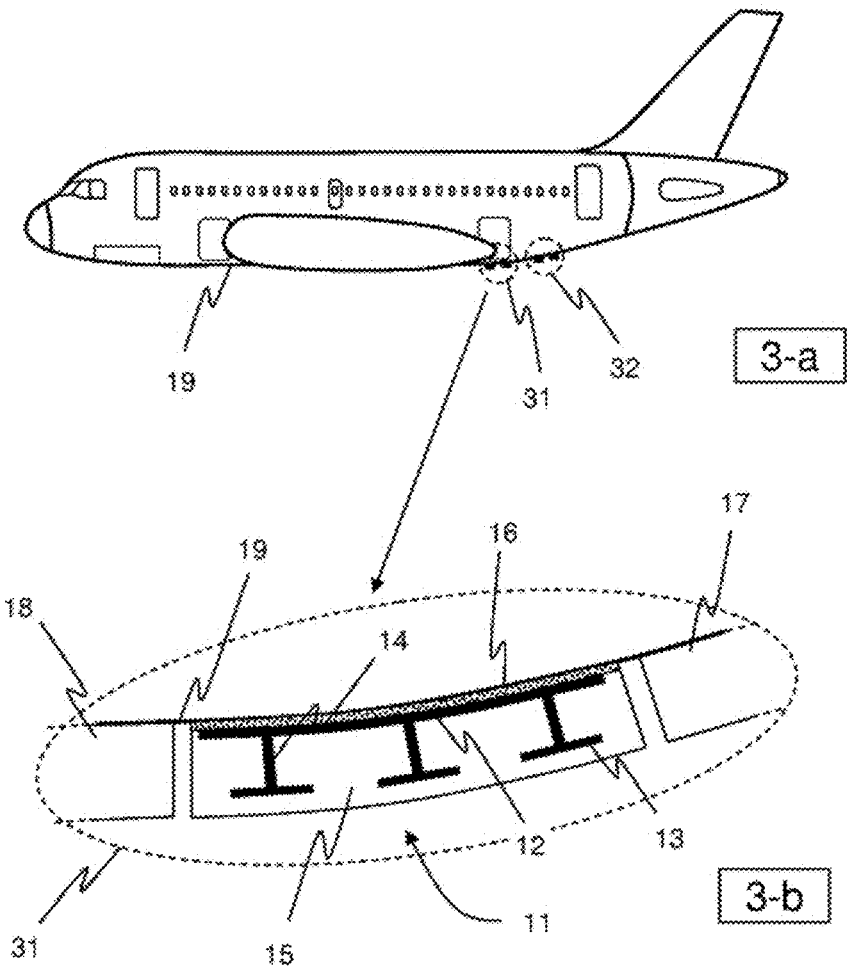
FIG. 3, the illustration of an exemplary application of the device according to the invention on an aircraft.

FIG. 3 presents an exemplary application of the device according to the invention to produce the decoupling of antennas forming a radioaltimeter, an item of equipment which is generally twinned, as illustrated by FIG. 3.

From a functional point of view, the device according to the invention is placed on the zone of the fuselage, 31 or 32, which separates the two antennas 17 and 18 of the radioaltimeter considered. These antennas are, for functional reasons, located under the fuselage, at a location where the wall 19 of the fuselage is generally not plane, so that the flexible, deformable character of the substrate 15 appears here as particularly advantageous.

As illustrated by the magnified view 3*b* of FIG. 3, the device is then held in place by simple gluing by means of the adhesive film 16.

In this exemplary application it is appreciated that, insofar as the fuselage is subject to a significant air flow, and that the fluidity of this flow is related to the aerodynamic qualities of the aircraft, it is important that the least possible disturbance of this flow be generated by putting the device according to the invention in place between the antennas 17 and 18.

Accordingly the thickness of the substrate 15 is determined in such a way that the device 11 has a thickness substantially identical to that of the patch antennas 17 and 18 between which it is placed. The shape and the dimensions of the patches 13 are then determined so as to maximize the impedance of the device, given the thickness of the substrate 15 and its dielectric characteristics.

Thus, for example, to produce the decoupling of the antennas of a radioaltimeter whose working frequency is about 4.3 GHz, and given the aerodynamic constraints, the device 11 according to the invention, such as illustrated by FIG. 1, can exhibit the following structural and dimensional characteristics:

Substrate made of polychloroprene of thickness equal to 3.175 mm and of relative permittivity equal to 3.5;

Metallization of the substrate's lower surface intended to be in contact with the fuselage;

Installation, on the opposite face of the substrate, of a matrix array of 15.19 metallic patches of square shape of dimensions 16.085 mm·16.085 mm;

Periodicity of the patches of the array equal to 20.25 mm in both directions.

Connection of the patches to the metallic plane by metallic vias of radius equal to 0.7221 mm The use of a device of flexible structure, the fixing of which can be performed by simple gluing, represents, in this exemplary implementation in particular, a really advantageous, simple solution, which makes it possible in particular, when the device is mounted, after fabrication, on the fuselage of an aircraft already in service, to simplify the operations necessary for mounting this device and to not require any modifications of the fuselage that might degrade the structural integrity of the platform nor to entail any operations for checking this integrity. Neither is it now necessary to provide any protection coating, of paint or other type, to limit the aerodynamic constraints which could be imposed on more rigid forms of structure. However, to produce mechanical protection of the patches it is possible for example to cover the surface of the substrate which carries the patches with a covering layer consisting of the same substrate, thus yielding a homogeneous structure, in which the patches are included.

The embodiment illustrated by FIGS. 1 to 3 corresponds to a particular form of production, the main advantage of which is its ability to be mounted on any type of support, conducting or otherwise. The fact of having a ground plane 12 integrated into the device does indeed make it possible to mount the latter on any support without the decoupling characteristics thereof being impaired.

Moreover, such an embodiment makes it possible to have conducting elements, patches, exhibiting an inductive and capacitive impedance, the inductive component of the impedance resulting from the presence of vias 14 linking each patch 13 to the ground plane 12 made by the conducting material sheet integrated into the device.

However, it is possible to consider other, simpler, embodiments which nonetheless provide the device according to the invention with the advantageous characteristics of ease of mounting on existing structures and of effectiveness both in terms of decoupling and of aerodynamic disturbances. An essential characteristic of the invention being here the malleability of the device and its propensity to easily fit the profile of the surface on which it is fixed, so that its actual fixing does not require the implementation of any means that could impair in any manner whatsoever the surface of the structure considered, a simple adhesive layer being sufficient.

Thus, it is possible to consider an embodiment for which the patches 13 are mounted floating with respect to the ground plane 12 consisting of the metallic sheet, the vias linking the patches to the ground plane then being absent from the structure, the latter remaining moreover identical to that of the previous embodiment.

Figure 4:
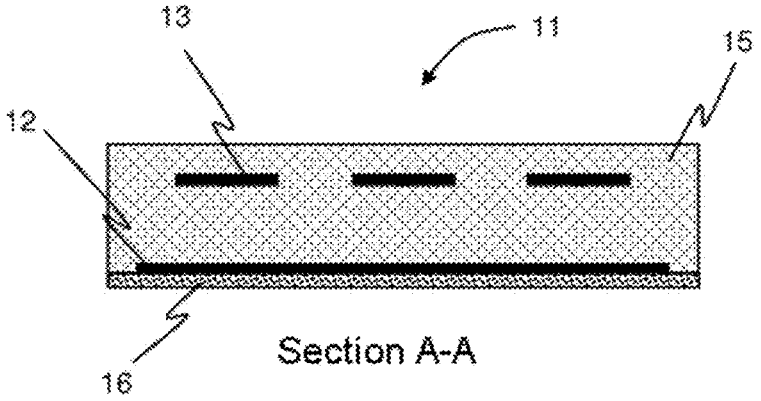
FIG. 4, a sectional view in section on A-A of the device according to the invention in a second embodiment.

The absence of vias linking the patches 13 to the ground plane 12 have the sole effect that the impedance of the device thus obtained is essentially capacitive, the decoupling being able moreover to have the same value as in the previous embodiment. Such an embodiment is illustrated by FIG. 4.

Alternatively it is also possible to consider an embodiment more particularly suitable for placement on a support itself forming a ground plane. The "ground plane" function ensured by the metallic sheet 12 in the first embodiment described can then be ensured directly by the support, so that said sheet disappears.

Such an embodiment is thus particularly suitable for putting in place on the surface 19 of the fuselage of an aircraft, generally a metallic surface 19 or one fabricated from composite materials integrating metallic protection to meet "electrical" requirements such as lightning protection or else maintenance of electrical continuity. The surface of the aircraft then constitutes the ground plane on which the device is fixed on the structure.

Figure 5:
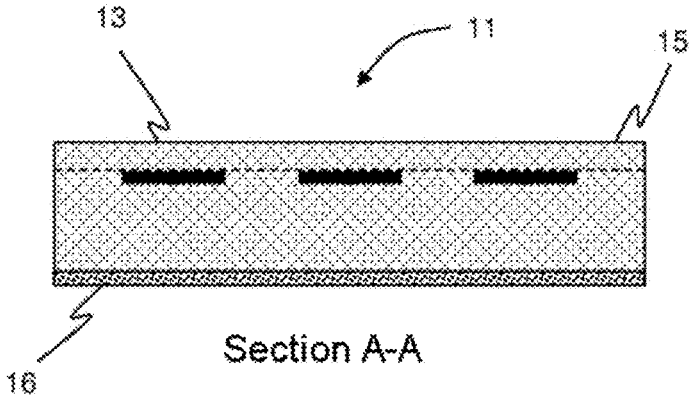
FIG. 5, a sectional view in section on A-A of the device according to the invention in a third embodiment.

The structure of the device then simply amounts to a surface, integrated into the thickness of a substrate layer, and consisting of patches such as those described above. Such an embodiment is illustrated by FIG. 5.

This embodiment exhibits the advantage of obtaining a very homogeneous device, formed of a substrate layer in which the patches are incorporated, and which is therefore more resistant to abrasion, without needing to put in place a complementary protection coating. The device obtained moreover exhibits the advantage of being easier to fix by means of adhesive on the support considered, insofar as the lower face of the device consists of the surface of the substrate directly in contact with the adhesive film 16 and not of a metallic sheet. Such an embodiment is thus perfect for use in order to carry out operations for putting in place an additional decoupling element such as that illustrated by FIG. 3.

As emerges from the above description, the major advantage of the device according to the invention resides, more generally, in the fact that putting it in place on an existing structure so as to improve the decoupling of two antennas mounted on this structure, in proximity to one another, requires practically no intervention on the structure itself nor on the antennas concerned. Furthermore the flexible and monobloc structure of the device makes it possible advantageously to mount it on any support profile, plan or otherwise, the fixing of the device on the support considered being able to be carried out by simple gluing, by means of an adhesive film for example, despite the aerodynamic constraints to which the device may be subjected, when it is mounted on the surface of an aircraft fuselage in particular.

The cost and the complexity of implementation of such a solution being thus advantageously low, the implementation of this solution is not limited to complex and fragile structures such as an aircraft fuselage, but may be considered for various structures.

The invention claimed is:

1. A high-impedance passive device to provide a given radio-electric decoupling between two separated antennas operating at least partially in a common frequency band and already arranged on a surface of a carrier structure, comprising a substrate comprising a flexible dielectric material layer of a predetermined thickness with patches disposed on a surface of the flexible dielectric material layer, the patches being made of conducting material exhibiting a predetermined geometry and a predetermined arrangement; and an attachment layer to fix the high-impedance passive device on a ground plane on the surface of the carrier structure such that the flexible dielectric material layer formed by the patches is separated from the surface of the carrier structure by a substrate thickness, which is determined as a function of the predetermined geometry, a number and the predetermined arrangement of the patches, and aerodynamic constraints imposed on the high-impedance passive device exhibiting an impedance to produce the given decoupling in the common frequency band.

2. The device as claimed in claim 1, wherein the dielectric material of the substrate is a flexible material of elastomer type configured to fit a shape of the surface of the carrier structure on which the high-impedance passive device is mounted.

3. The device as claimed in claim 2, wherein the dielectric material is polychloroprene.

4. The device as claimed in claim 1, wherein the ground plane on which the high-impedance passive device is fixed comprises the carrier structure.

5. The device as claimed in claim 1, wherein the ground plane on which the high-impedance passive device is fixed comprises a sheet of conducting material having a predetermined thickness and placed on a face of the high-impedance passive device in contact with the surface of the carrier structure.

6. The device as claimed in claim 5, wherein the patches are electrically linked to the sheet of conducting material by conductors or vias.

7. The device as claimed in claim 1, wherein the attachment layer comprises an adhesive material layer disposed on a face of the high-impedance passive device in contact with the surface of the carrier structure.

8. The device as claimed in claim 1, wherein the substrate covers a plane of the patches to ensure mechanical protection of a free surface of the high-impedance passive device.

9. The device as claimed in claim 1, wherein an external surface of the high-impedance passive device is covered with a purely dielectric coating.

10. The device as claimed in claim 1, wherein a thickness of the high-impedance passive device is substantially identical to a thickness of the two separated antennas between which the high-impedance passive device is placed.

* * * * *